US011374313B2

(12) United States Patent
Park

(10) Patent No.: US 11,374,313 B2
(45) Date of Patent: Jun. 28, 2022

(54) BIAXIAL ANTENNA USING SINGLE MOTOR

(71) Applicant: WIWORLD CO., LTD., Daejeon (KR)

(72) Inventor: Chan Goo Park, Daejeon (KR)

(73) Assignee: WIWORLD CO., LTD., Daejeon (KR)

( * ) Notice: Subject to any disclaimer, the term of this patent is extended or adjusted under 35 U.S.C. 154(b) by 81 days.

(21) Appl. No.: 16/755,128

(22) PCT Filed: Apr. 3, 2018

(86) PCT No.: PCT/KR2018/003878
§ 371 (c)(1),
(2) Date: Apr. 9, 2020

(87) PCT Pub. No.: WO2019/074175
PCT Pub. Date: Apr. 18, 2019

(65) Prior Publication Data

US 2021/0376460 A1 Dec. 2, 2021

(30) Foreign Application Priority Data

Oct. 11, 2017 (KR) ..... 10-2017-0130276

(51) Int. Cl.
*H01Q 3/08* (2006.01)
*H01Q 1/12* (2006.01)

(52) U.S. Cl.
CPC ..... *H01Q 3/08* (2013.01); *H01Q 1/125* (2013.01); *H01Q 1/1264* (2013.01)

(58) Field of Classification Search
CPC .... H01Q 1/125; H01Q 1/1257; H01Q 1/1264; H01Q 3/02; H01Q 3/08
See application file for complete search history.

(56) References Cited

U.S. PATENT DOCUMENTS

2007/0103366 A1* 5/2007 Park ..... H01Q 1/3275 342/359
2007/0216592 A1 9/2007 Park
(Continued)

FOREIGN PATENT DOCUMENTS

JP H05-67909 A 3/1993
KR 10-0553564 B1 2/2006
(Continued)

OTHER PUBLICATIONS

Office Action of Korean Patent Application No. 10-2017-0130276—5 pages (dated Sep. 14, 2020).
(Continued)

*Primary Examiner* — Robert Karacsony
(74) *Attorney, Agent, or Firm* — Knobbe Martens Olson & Bear LLP

(57) ABSTRACT

The present invention relates to a biaxial antenna using a single motor capable of simplifying an apparatus and saving a manufacturing cost by controlling elevation and azimuth with the single motor. The biaxial antenna includes a fixed central shaft having a screw thread formed on an outer circumference surface thereof, a rotation part having a screw thread formed on an inner circumference surface thereof to be coupled to the fixed central shaft, rotated, and including a first rotation plate which is moved to an upper side or a lower side, an antenna part having a rear surface connected to the first rotation plate and both sides hinge coupled to the rotation part, a motor connected to the rotation part to rotate the rotation part, and a controller controlling the number of revolutions and the degree of rotation of the motor to control elevation and azimuth of the antenna part.

7 Claims, 8 Drawing Sheets

(56) References Cited

U.S. PATENT DOCUMENTS

| | | | |
|---|---|---|---|
| 2010/0259458 | A1 | 10/2010 | Mattis et al. |
| 2010/0265149 | A1 | 10/2010 | Omori et al. |

FOREIGN PATENT DOCUMENTS

| | | | |
|---|---|---|---|
| KR | 10-1187925 | B1 | 10/2012 |
| KR | 10-1734217 | B1 | 5/2017 |

OTHER PUBLICATIONS

International Search Report of corresponding PCT Application No. PCT/KR2018/003878—2 pages (dated Jul. 10, 2018).

* cited by examiner (a)

(b)

BIAXIAL ANTENNA USING SINGLE MOTOR

TECHNICAL FIELD

The following disclosure relates to a biaxial antenna using a single motor capable of simplifying an apparatus and saving manufacturing cost by controlling elevation and azimuth with the single motor.

BACKGROUND ART

An antenna for satellite communication adjusts two shafts, that is, elevation and azimuth thereof so as to face a satellite. The elevation refers to an angle in a direction perpendicular to the ground and azimuth refers to an angle of a horizontal direction based on an axis perpendicular to the ground.

The applicant has conventionally filed and registered a technique for adjusting elevation and azimuth of an antenna by controlling two shafts (Korean Patent Publication No. 10-0553564 entitled: "An Improved Satellite Antenna System for Removal Embarkation, and Its Method", published on Feb. 22, 2006 (hereinafter, referred to as Related Art 1)).

The antenna controlling the two shafts like Related Art 1 uses a method in which separate belts and motors are connected to each of the shafts to separately control each of the shafts. According to the method described above, since two motors should be used and a controller such as a micro controller unit (MCU) for controlling each of the motors should be added as much as the same number as the motors, there was a problem in that the apparatus becomes complicated and a manufacturing cost thereof rises. In addition, the maintenance cost due to the failure of the product is also increased.

RELATED ART DOCUMENT

Patent Document

Korean Patent Publication No. 10-0553564 titled "An Improved Satellite Antenna System for Removal Embarkation, and Its Method", published on Feb. 22, 2006

DISCLOSURE

Technical Problem

An embodiment of the present invention is directed to providing a biaxial antenna using a single motor capable of simplifying an apparatus configuring the antenna and saving a manufacturing cost thereof by simultaneously controlling elevation and azimuth using the single motor.

Technical Solution

In one general aspect, a biaxial antenna using a single motor includes a motor; a rotation part including a first rotation plate which is moved to an upper side or a lower side according to rotation of the motor and rotated by the motor; a fixed central shaft coupled to the rotation part; an antenna part installed on the rotation part to be rotated in a horizontal direction according to rotation of the rotation part, and coupled to the rotation part and the first rotation plate to change an angle thereof in a vertical direction according to a movement of the first rotation plate; and a controller controlling the motor to control the degree of rotation of the antenna part in the horizontal direction and the vertical direction.

The fixed central shaft may have a screw thread formed on an outer circumference surface thereof, and the first rotation plate may include a hole having a screw thread formed on an inner circumference surface thereof and coupled to the fixed central shaft to be moved to an upper side or a lower side along the fixed central shaft according to the rotation thereof.

The motor may include a first rotation shaft and a second rotation shaft which are in synchronization with each other at both sides thereof and are rotated, the first rotation shaft may be connected to the rotation part to rotate the rotation part, and the second rotation shaft may be connected to the first rotation plate to move the first rotation plate to the upper side or the lower side according to the rotation thereof.

The second rotation shaft may have a screw thread formed on an outer circumference surface thereof, and the first rotation plate may include a hole having a screw thread formed on an inner circumference surface thereof and coupled to the second rotation shaft to be moved to the upper side or the lower side along the second rotation shaft by the rotation of the second rotation shaft.

The antenna part may include an antenna; and a connection part connecting the antenna and the rotation part to each other.

The connection part may include a hinge member hinge coupling the antenna and the rotation part to each other; and a power transfer member connecting the antenna and the first rotation plate to each other to allow the antenna to be rotated in a predetermined angle range through the hinge member with the hinge coupled portion between the antenna and the rotation part as a shaft according to a vertical movement of the first rotation plate.

The power transfer member may include a guide part extending in one side, and the first rotation plate may include a sliding member inserted into the guide part such that the sliding member is moved along the guide part when the first rotation plate is moved to the upper side or the lower side.

The rotation part may further include a pulley and a belt connecting the pulley and the motor to transfer rotation force of the motor to the rotation part.

The motor may be installed on the rotation part.

The number of revolutions of the rotation part to one side or the other side may be limited.

Advantageous Effects

According to the biaxial antenna using the single motor according to the present invention, even if the single motor is used, the elevation may be controlled according to the number of revolutions of the rotation part and the azimuth may be controlled according to the degree of rotation of the rotation part, such that the apparatus may be simplified and the manufacturing cost and the maintenance cost may be saved.

BEST MODE

Hereinafter, exemplary embodiments of a biaxial antenna using a single motor according to the present invention will be described in detail with reference to the accompanying drawings.

First Exemplary Embodiment

Figure 1:
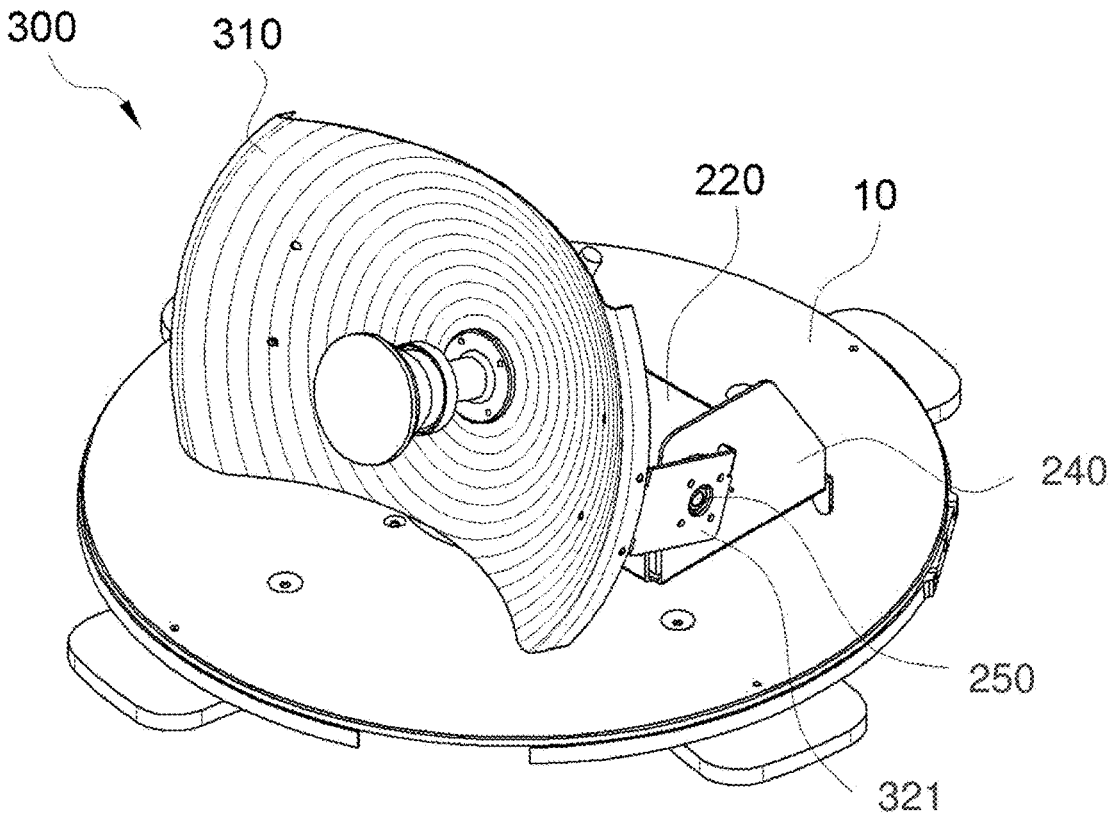
FIGS. 1 and 2 are perspective views of a biaxial antennal using a single motor according to a first exemplary embodiment of the present invention, viewed from different angles.
Figure 2:
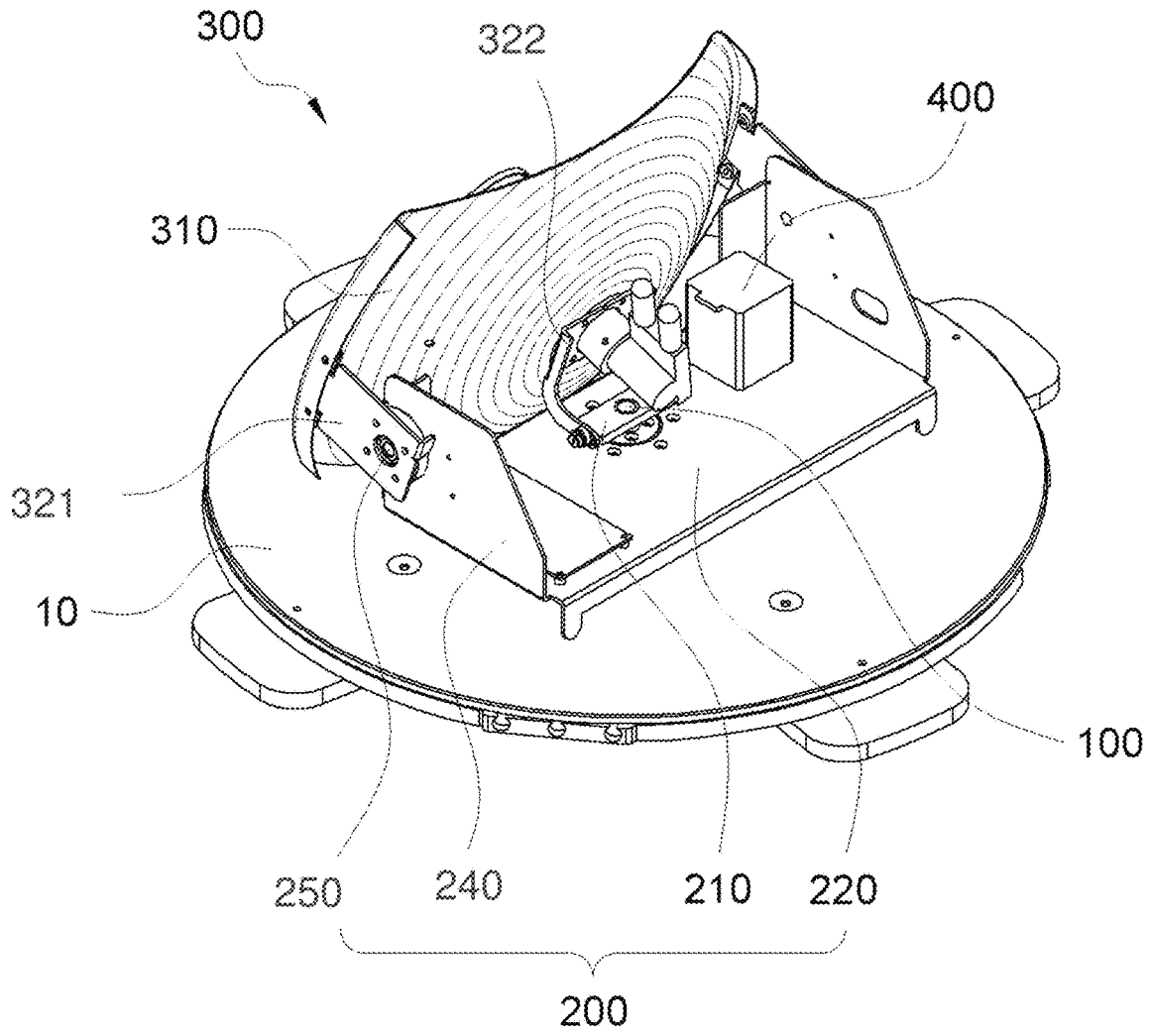
Figure 3:
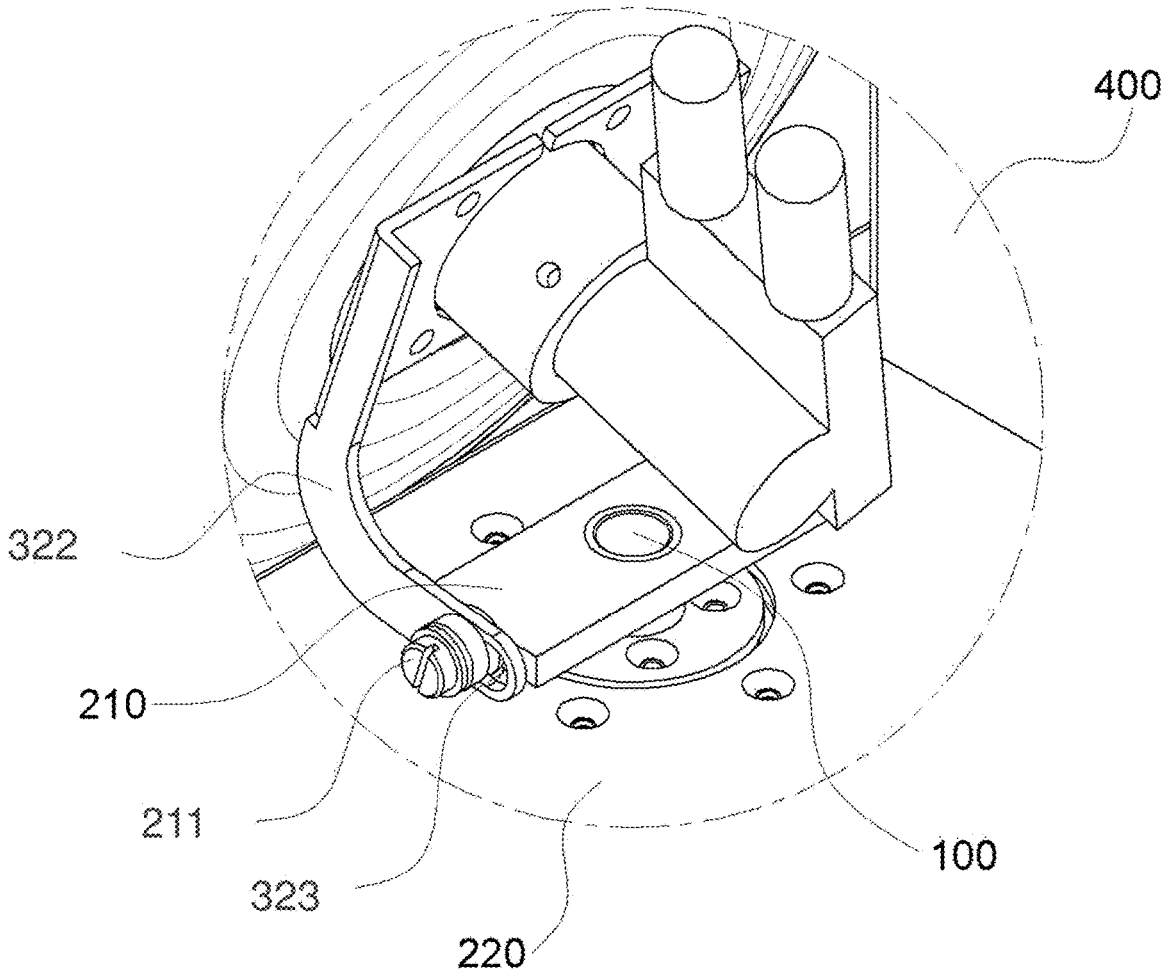
FIG. 3 is a partial enlarged view of FIG. 2.
Figure 4:
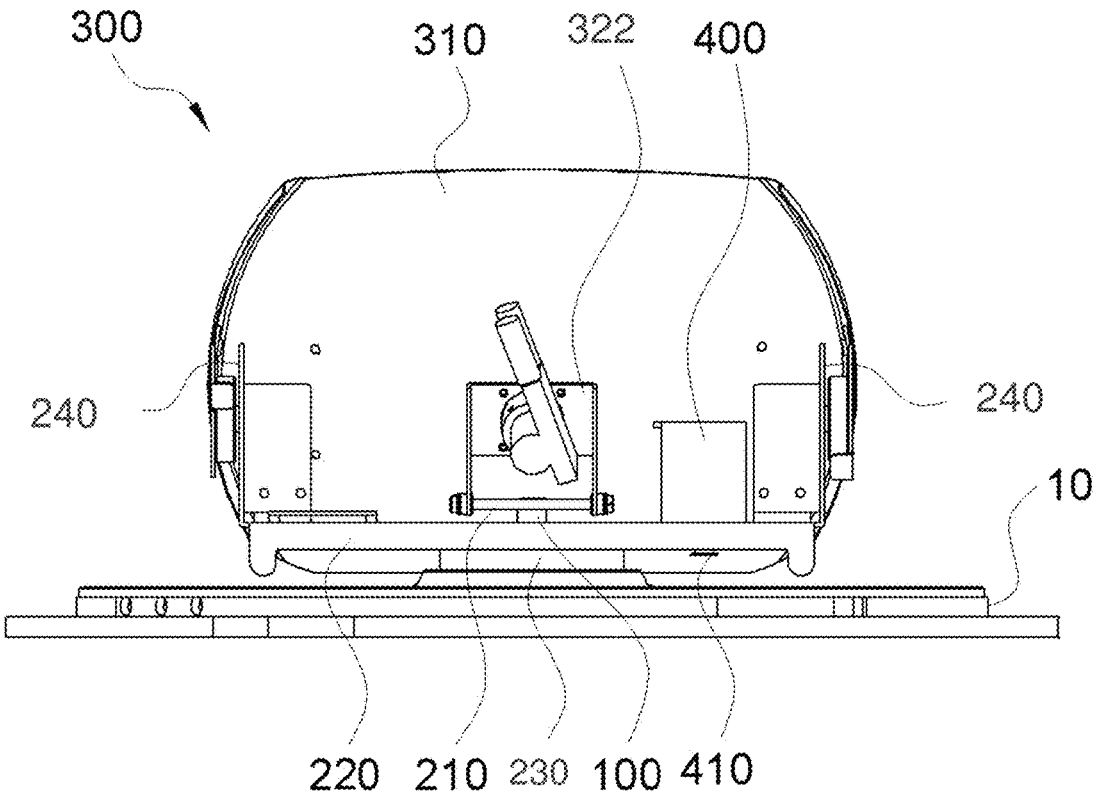
FIG. 4 is a rear plan view of the biaxial antenna using the single motor according to the first exemplary embodiment of the present invention.

FIG. 1 illustrates a front of a biaxial antennal using a single motor according to a first exemplary embodiment of the present invention (hereinafter, referred to as a first exemplary embodiment), FIG. 2 illustrates a rear of the first exemplary embodiment of the present invention, FIG. 3 illustrates a partial enlarged view of FIG. 2, and FIG. 4 illustrates a rear plan view of the first exemplary embodiment of the present invention.

As illustrated in FIGS. 1 to 3, a biaxial antenna using a single motor according to an exemplary embodiment of the present invention may include a fixed central shaft 100, a rotation part 200, an antenna part 300, and a motor 400.

The fixed central shaft 100 illustrated in FIG. 2 is coupled to a fixed plate 10 and extends to an upper side. The fixed central shaft 100 has a screw thread formed on an outer circumference surface of a portion of the upper side thereof, serves as a central shaft around which the rotation part 200 to be described below rotates, and is fixed without being rotated. However, an exemplary embodiment in which the screw thread is not formed on the outer circumference surface of the fixed central shaft 100 is possible and will be described below.

The rotation part 200 is a part which is directly rotated according to the first exemplary embodiment of the present invention, and may include a first rotation plate 210, a second rotation plate 220, a pulley 230, and a belt (not shown) as illustrated in FIGS. 2 and 4.

The first rotation plate 210, which is a portion rotated by the motor 400, is connected to the antenna 310 to be described below and is coupled to the fixed central shaft 100 by the fixed central shaft 100 which is inserted into a central portion thereof as illustrated in FIGS. 2 and 3. A screw thread corresponding to the screw thread formed on the outer circumference surface of the fixed central shaft 100 is formed on an inner circumference surface of a hole formed in a middle end of the first rotation plate 210 and into which the fixed central shaft 100 is inserted. That is, the fixed central shaft 100 and the first rotation plate 210 may be screw coupled to each other.

As described above, when the first rotation plate 210 rotates in a state in which the fixed central shaft 100 and the first rotation plate 210 are screw coupled to each other, the first rotation plate 210 moves to an upper side or a lower side along the fixed central shaft 100.

As illustrated in FIGS. 2 and 3, the second rotation plate 220 is a portion on which the antenna part 300 is installed and is rotated by the motor 400. In addition, the fixed central shaft 100 is inserted into and coupled to the second rotation plate 220. Although not illustrated in FIGS. 2 and 3, a bearing may be installed between the fixed central shaft 100 and the second rotation plate 220 so that rotation force is not transferred to the fixed central shaft 100 even in a case in which the second rotation plate 220 is rotated. That is, the second rotation plate 220 is not moved to the upper side or the lower side even in a case in which it is rotated unlike the first rotation plate 210.

As illustrated in FIG. 4, the pulley 230 is formed below the rotation part 200. In more detail, the pulley 230 is formed below the second rotation plate 220. The belt connects the pulley 230 and a first rotation shaft 410 formed below the motor 400 with each other to transfer rotation force generated from the motor 400 to the pulley 230, thereby rotating the rotation part 200 in which the pulley 230 is formed.

As illustrated in FIGS. 1 to 3, the antenna part 300 has a rear surface connected to the first rotation plate 210 and opposite sides which are hinge coupled to the rotation part 200. To this end, the antenna part 300 may include an antenna 310 and a connection part.

The antenna 310 illustrated in FIGS. 1 and 2 is a portion receiving satellite signals from a satellite. According to a first exemplary embodiment of the present invention, the antenna 310 is directed to a direction of the satellite by adjusting elevation and azimuth of the antenna 310 through rotation of the rotation part 200.

The connection part is a part connecting the antenna 310 and the rotation part 200 with each other. According to the first exemplary embodiment of the present invention, the connection part may include a hinge member 321 and a power transfer member 322.

The hinge member 321 hinge couples the antenna 310 and the rotation part 200 to each other to enable the antenna 310 to rotate in a predetermined angle range in a vertical direction with the hinge coupled portion as a shaft. The hinge member 321 will be described in more detail with reference to FIG. 2. A pair of hinge members 321 formed on both sides of a rear surface of the antenna 310 is hinge coupled to a pair of first brackets 240 protruding on an upper surface of the second rotation plate 220 and is installed to be rotatable within a predetermined angle range with the hinge coupled portions as shafts.

The extent to which the hinge member 321 and the first bracket 240 are coupled to each other may be configured to have fixing force of the extent to which the hinge member 321 or the first bracket 240 or not moved when external force is not separately applied to the hinge member 321 or the first bracket 240.

As illustrated in FIGS. 2 and 3, the power transfer member 322 has an "L" shape. One side (a lower side in FIG. 3) thereof is coupled to the first rotation plate 210 and the other side (an upper side in FIG. 3) thereof is coupled to the rear surface of the antenna 310 to connect the antenna 310 and the first rotation plate 210 to each other A method in which the power transfer member 322 is coupled to the first rotation plate 210 will be described with reference to FIG. 3. The first rotation plate 210 side of the power transfer member 322 includes a guide part 323 extending in one side thereof and the first rotation plate 210 includes a sliding member 211 inserted into the guide part 323, such that the sliding member 211 moves along the guide part 323 when the first rotation plate 210 is rotated and is moved to an upper side or a lower side along the fixing central shaft 100.

In FIG. 3, the guide part 323 has a shape which is formed to penetrate through the first rotation plate 210 and extending in one side thereof, but the shape of the guide part 323 according to the present invention is not limited to the exemplary embodiment illustrated in FIG. 3. For example, the guide part 323 may have a shape which is formed to be depressed in the first rotation plate 210 and extending in one side thereof.

As described above, the motor 400 is connected to the rotation part 200 to transfer the rotation force, thereby rotating the rotation part 200. A position of the motor 400 according to the present invention is not limited, but as illustrated in FIGS. 2 and 3, according to the present exemplary embodiment, the motor 400 may be installed on the second rotation plate 220 to allow the second rotation plate 220 to be rotated together with the rotation part 200.

In this case, as illustrated in FIG. 4, a first rotation shaft 410 of the motor 400 is disposed to face a lower side and protrudes to a lower side of the second rotation plate 220, and the first rotation shaft 410 and the pulley 230 are connected to each other by the belt such that rotation force of the first rotation shaft 410 may be transferred to the rotation part 200.

A controller (not shown) may control elevation and azimuth of the antenna part 300, more specifically, the antenna 310 by controlling the number of revolutions and the degree of rotation of the motor 400, and may be implemented in a form of a micro controller unit (MCU) which is installed to be adjacent to the motor 400.

Hereinafter, a method for adjusting elevation and azimuth of the antenna 310 according to an exemplary embodiment of the present invention will be described.

First, the present invention has been proposed based on a fact that there is not a large difference in elevation in one country or a wide area. For example, in the case of arbitrary geostationary satellite located in the sky over Korea, the difference in elevation between Sokcho in the north and Yeosu in the south is only as large as 3°. Therefore, according to the present invention, the elevation of the antenna 310 may be finely adjusted according to the number of revolutions of the rotation part 200, and the azimuth may be controlled by adjusting the degree of rotation of the rotation part 200 installed to be rotated in a direction of the azimuth at the same time.

Figure 5A:
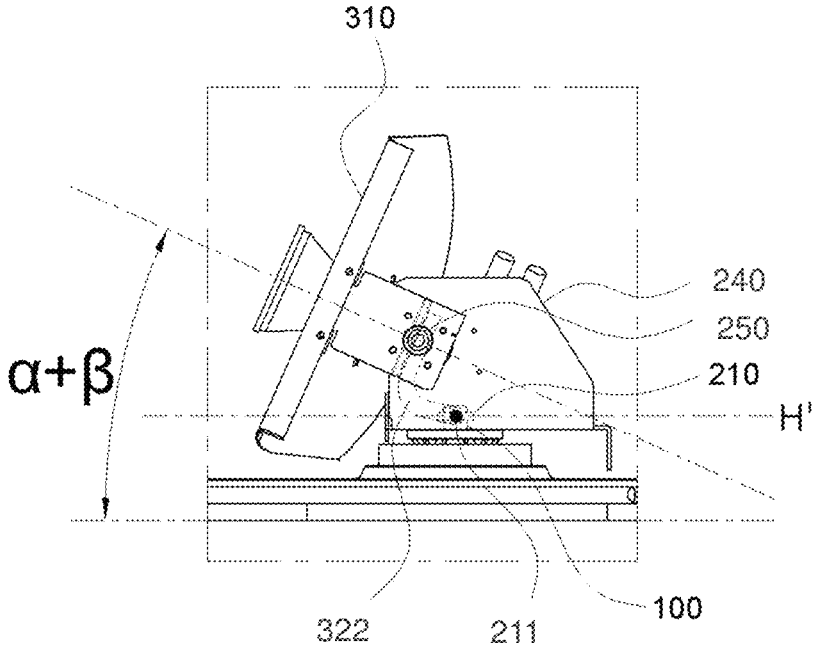
FIGS. 5A and 5B are schematic views of an elevation adjustment using the biaxial antenna using the single motor according to the first exemplary embodiment of the present invention.
Figure 5B:
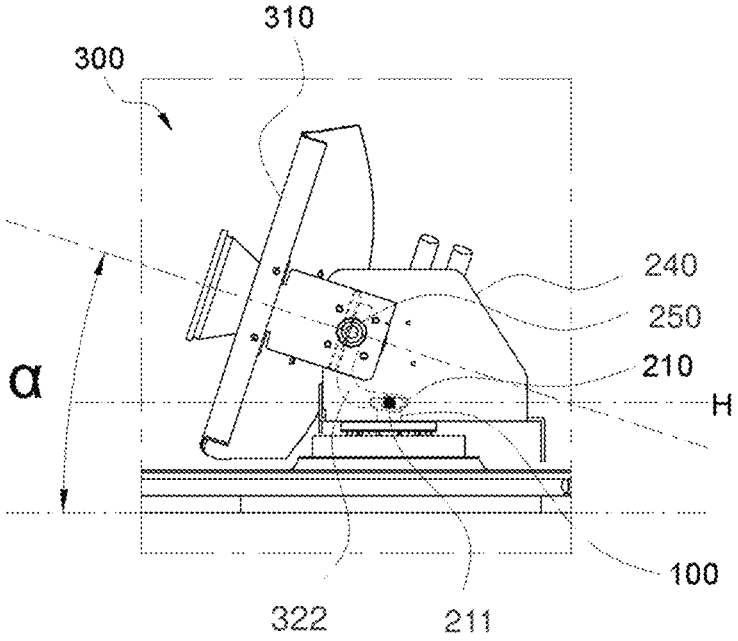

FIGS. 5A and 5B illustrate a process of controlling elevation according to an exemplary embodiment of the present invention. First, in a state illustrated in FIG. 5A, the elevation of the antenna 310 is a, and the position of the first rotation plate 210 is at a height H of an end of the upper side of the fixed central shaft 100.

In the state of FIG. 5A, the controller performs a control so that the first rotation plate 210 is moved to the lower side by the screw thread formed on the outer circumference surface of the fixed central shaft 100 by operating the motor to rotate the rotation part 200 in one side. Even if the first rotation plate 210 is moved to the lower side, the height of the rotation part except for the first rotation plate 210 is not changed. Therefore, the hinge member 321 and the antenna 310 connected to the hinge member 321 are rotated in a predetermined angle range with the hinge coupled portion between the hinge member 321 and the first bracket 240 as a shaft. As a result, the elevation is increased to $\alpha+\beta$ as illustrated in FIG. 5B. In this case, the height of the first rotation plate 210 may be a height H' of the middle end of the fixed central shaft 100.

The change amount of the elevation per one rotation of the rotation part 200 may be changed by adjusting the screw threads formed on the fixed central shaft 100 and the first rotation plate 210, or reducing/extending a distance between a hinge part 250 and the first rotation plate 210.

In addition, the number of revolutions of the rotation part 200 may be limited. The reason is because a range of the elevation required by a specific region may be limited as described above. The reason why the number of revolutions of the rotation part 200 is limited is that a control range of the elevation on the specific region is limited as described above. An example of a method for controlling the rotation of the rotation part 200 may include a method for physically limiting the movement of the first rotation plate 210 to the upper side or the lower side or limiting an operation of the motor 400 by measuring, by the controller, the degree of rotation of the rotation part 200 and using the measured degree of rotation as a feedback signal.

Figure 6A:
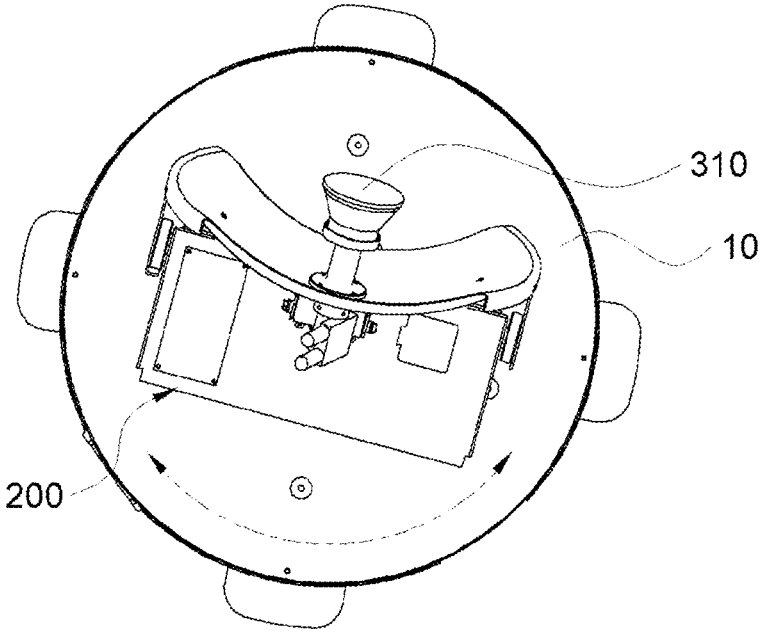
FIGS. 6A and 6B are schematic views of an azimuth adjustment using the biaxial antenna using the single motor according to the first exemplary embodiment of the present invention.
Figure 6B:
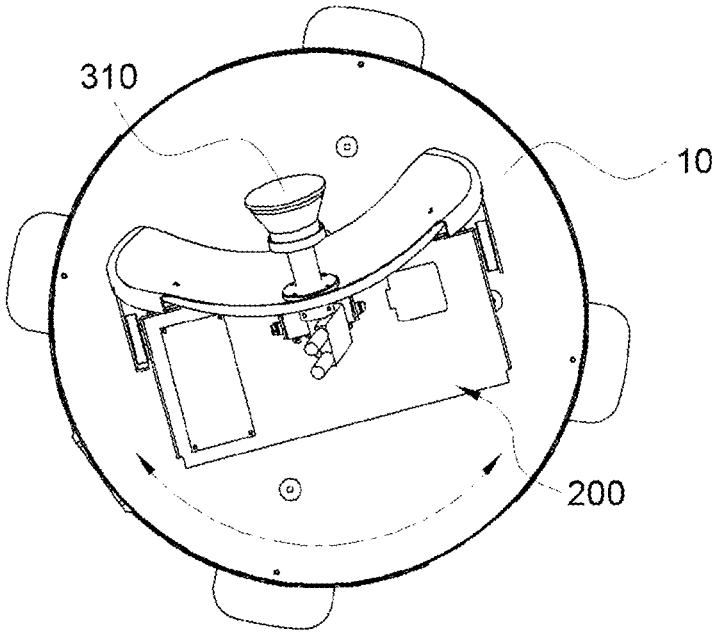

According to an exemplary embodiment of the present invention, after the elevation of the antenna 310 is controlled through the process of FIG. 5, the azimuth may be controlled. FIGS. 6A and 6B illustrate a process of controlling azimuth according to an exemplary embodiment of the present invention. The controller controls the azimuth of the antenna 310 by simply operating the motor 400 to adjust the degree of rotation of the rotation part 200.

Second Exemplary Embodiment

Hereinafter, a biaxial antenna using a single motor according to a second exemplary embodiment of the present invention will be described in detail with reference to the accompanying drawings.

Figure 7:
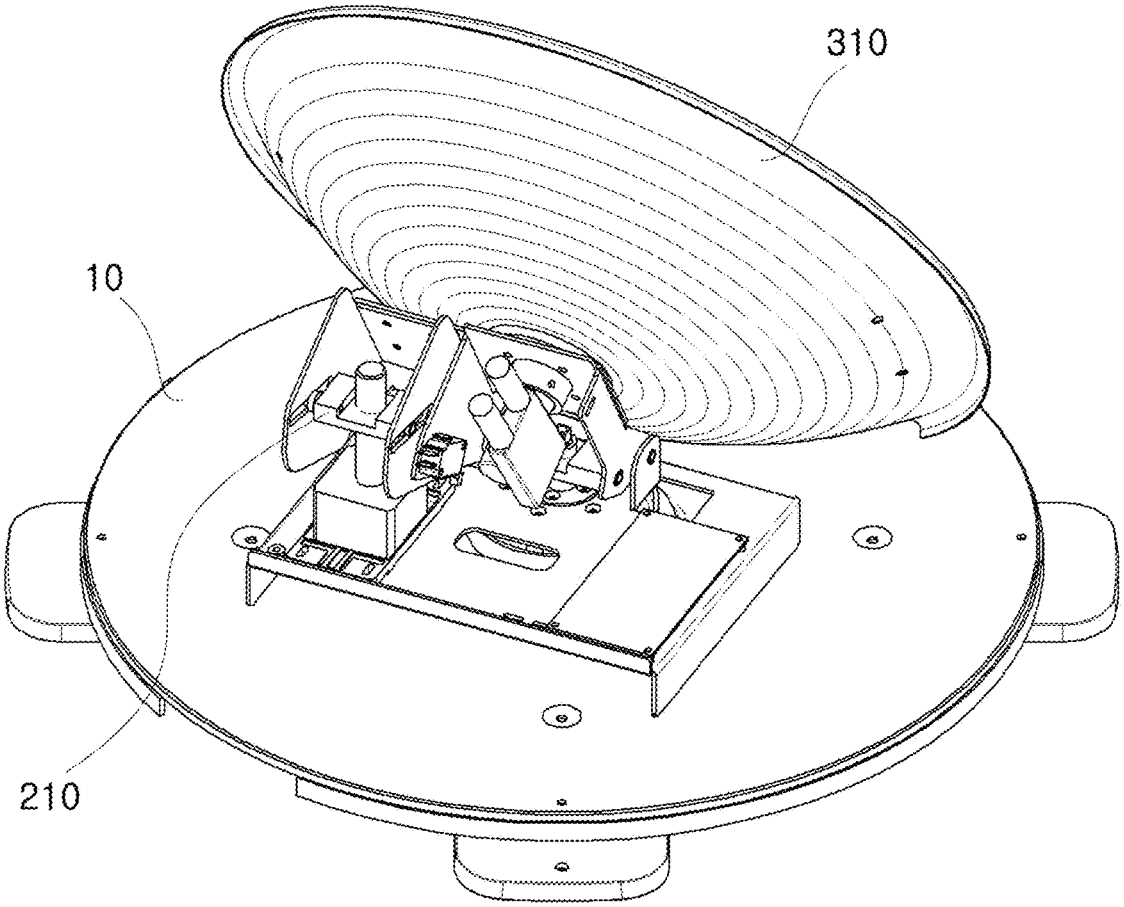
FIG. 7 is a perspective view of a biaxial antenna using a single motor according to a second exemplary embodiment of the present invention.
Figure 8:
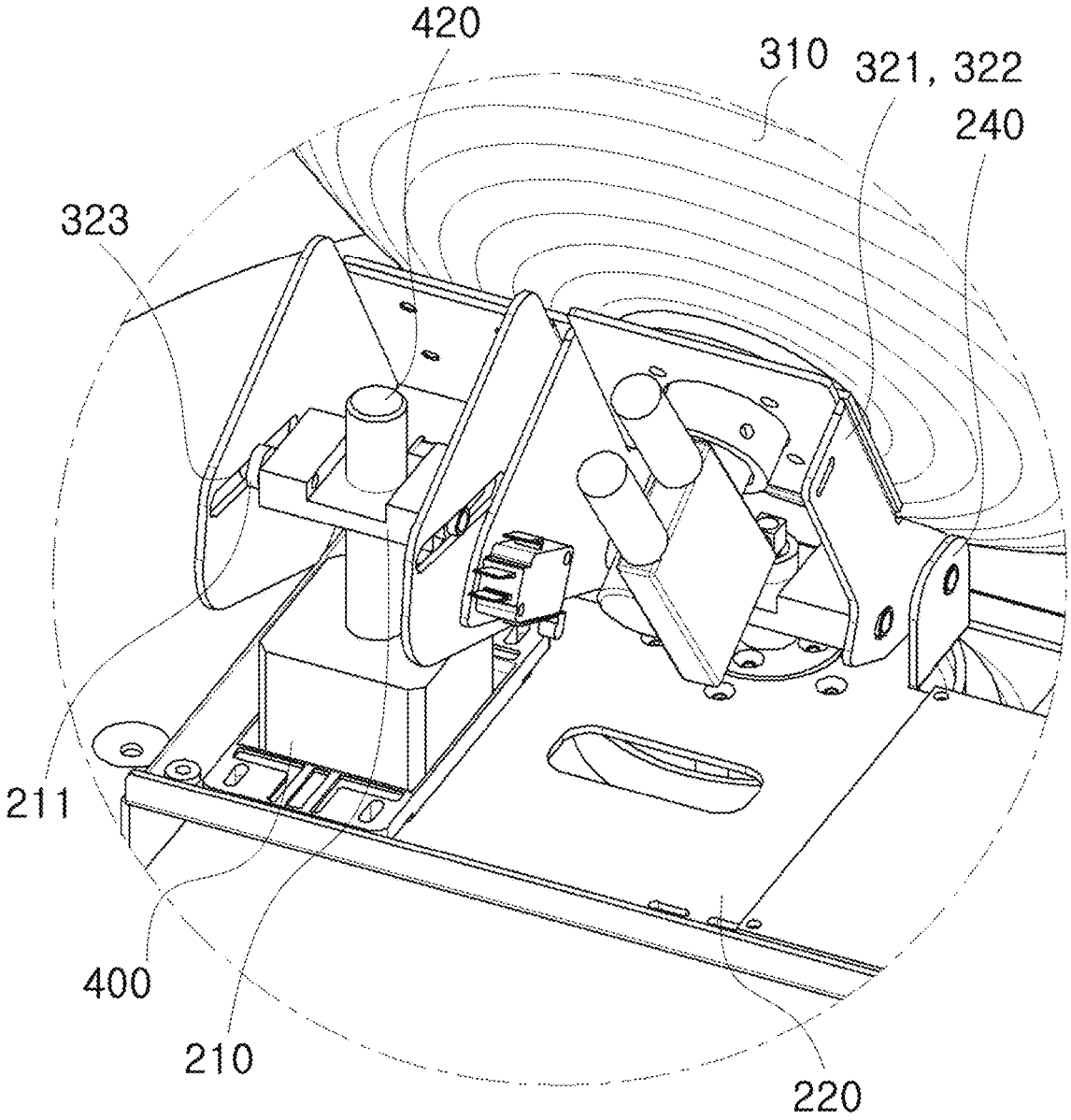
FIG. 8 is a partial enlarged view of FIG. 7.

FIG. 7 illustrates a rear surface of a biaxial antenna (hereinafter, referred to as a second exemplary embodiment) using a single motor according to a second exemplary embodiment of the present invention and FIG. 8 is a partial enlarged view of FIG. 7.

As illustrated in FIGS. 7 and 8, according to the second exemplary embodiment of the present invention, since the position of the first rotation plate 210 is changed unlike the first exemplary embodiment, the elevation of the antenna 310 is controlled by another method.

As illustrated in FIG. 8, the first rotation plate 210 includes a hole having a screw thread formed on an inner circumference surface thereof in the same way as the first exemplary embodiment, but the fixed central shaft is not coupled to the hole and the second rotation shaft 420 included in the motor 400 is coupled to the hole. In this case, the screw thread is formed on the outer circumference surface of the second rotation shaft 420 or a separate member on which the screw thread is formed is coupled to the second rotation shaft 420, such that the first rotation plate 210 may be vertically moved according to the rotation of the second rotation shaft 420.

A pair of sliding members 211 is formed on both sides of the first rotation plate 210, and the sliding members 211 enable the first rotation plate 210 to move along the guide part 323 formed in the power transfer member 322 when the first rotation plate 210 is moved to an upper side or a lower side.

As illustrated in FIG. 8, the power transfer member 322 and the hinge member 321 may be integrated with each other unlike the first exemplary embodiment, may be hinge coupled to the first bracket 240 formed on the second rotation plate 220, and may be rotated in a predetermined angle range with the hinge coupled portion between the hinge member 321 and the first bracket 240 as a shaft when the first rotation plate 210 is moved to the upper side or the lower side.

Although not illustrated in FIG. 8, a first rotation shaft is also formed below the motor 400, the first rotation shaft may be connected to a pulley formed below the second rotation plate 220 by a belt to rotate the second rotation plate 220, and the first rotation shaft may be rotated in synchronization with the second rotation shaft 420, or may be rotated in a non-synchronization state with the second rotation shaft.

In summary, according to the second exemplary embodiment of the present invention illustrated in FIGS. 7 and 8, the elevation of the antenna 310 may be adjusted by a method in which the first rotation plate 210 is coupled to the second rotation shaft 420 of the motor 400 to be moved to the upper side or the lower side, and the first rotation shaft may be connected to the second rotation plate 220 to adjust the azimuth of the antenna 310.

According to the biaxial antenna using the single motor according to the present invention, even if the single motor is used, the elevation may be controlled according to the number of revolutions of the rotation part and the azimuth may be controlled according to the degree of rotation of the rotation part, such that the apparatus may be simplified and the manufacturing cost and the maintenance cost may be saved.

The present invention is not limited to the above-mentioned exemplary embodiments, but may be variously applied, and may be variously modified without departing from the gist of the present invention claimed in the following claims.

DETAILED DESCRIPTION OF MAIN ELEMENTS

10: fixed plate
100: fixed central shaft
200: rotation part
210: first rotation plate
211: sliding member
220: second rotation plate
230: pulley
240: first bracket
300: antenna part
310: antenna
321: hinge member
322: power transfer member
323: guide part
400: motor
410: first rotation shaft
420: second rotation shaft

What is claimed is:

1. A biaxial antenna using a single motor, the biaxial antenna comprising:

a motor;

a rotation part including a first rotation plate configured to be rotated and moved by the motor;

a fixed central shaft coupled to the rotation part at a center of the first rotation plate, wherein the first rotation plate is configured to move along the fixed central shaft in a vertical direction;

an antenna part coupled to the rotation part and configured to be rotated in response to the rotation of the rotation part about the fixed central shaft, wherein the antenna part is further configured to be tilted around a rotational axis of the antenna part in response to the movement of the first rotation plate in the vertical direction; and a controller configured to control the rotation of the antenna part in response to the rotation of the rotation part about the fixed central shaft and the movement of the first rotation plate in the vertical direction, wherein the antenna part includes:

an antenna;

a hinge member configured to hinge-couple the antenna and the rotation part; and a power transfer member connecting the antenna and the first rotation plate to allow the antenna to be rotated in a predetermined angle range through the hinge member with a hinge coupled portion between the antenna and the rotation part as the rotational axis of the antenna part in response to the movement of the first rotation plate in the vertical direction, wherein a sliding member is disposed at an end portion of the first rotation plate along a length direction of the first rotation plate, and wherein the power transfer member includes a guide part configured to receive the sliding member such that the sliding member moves along the guide part in response to the first rotation plate moving along the fixed central shaft.

2. The biaxial antenna of claim 1, wherein the fixed central shaft has a screw thread on an outer circumference surface of the fixed central shaft, and the first rotation plate includes a hole having a screw thread on an inner circumference surface of the first rotation plate and coupled to the fixed central shaft to be moved to upwards or downwards along the fixed central shaft according to the rotation thereof.

3. The biaxial antenna of claim 1, wherein the motor includes a first rotation shaft and a second rotation shaft which are in synchronization with each other at both sides of the motor and are rotated, the first rotation shaft is connected to the rotation part to rotate the rotation part, and the second rotation shaft is connected to the first rotation plate to move the first rotation plate to upwards or downwards according to the rotation of the second rotation shaft.

4. The biaxial antenna of claim 3, wherein the second rotation shaft has a screw thread on an outer circumference surface of the second rotation shaft, and the first rotation plate includes a hole having a screw thread on an inner circumference surface of the first rotation plate and coupled to the second rotation shaft to be moved to the upper side or the lower side along the second rotation shaft by the rotation of the second rotation shaft.

5. The biaxial antenna of claim 1, wherein the rotation part further includes a pulley and a belt connecting the pulley and the motor to transfer rotation force of the motor to the rotation part.

6. The biaxial antenna of claim 1, wherein the motor is disposed on the rotation part.

7. The biaxial antenna of claim 1, wherein the number of revolutions of the rotation part to one side or the other side is limited.

* * * * *